United States Patent [19]

Knieps

[11] 4,278,014

[45] Jul. 14, 1981

[54] ARRANGEMENT FOR COVERING A GUIDE CHANNEL

[75] Inventor: Horst H. Knieps, Wuppertal, Fed. Rep. of Germany

[73] Assignee: Hoesch Werke Aktiengesellschaft, Dortmund, Fed. Rep. of Germany

[21] Appl. No.: 102,392

[22] Filed: Dec. 11, 1979

[30] Foreign Application Priority Data

Dec. 11, 1978 [DE] Fed. Rep. of Germany ..... 2853440

[51] Int. Cl.[3] ..... B65B 13/04

[52] U.S. Cl. ..... 100/26

[58] Field of Search ..... 100/25, 26

[56] References Cited

U.S. PATENT DOCUMENTS

| | | | |
|---|---|---|---|
| 2,959,118 | 11/1960 | Hager | 100/26 |
| 3,179,037 | 4/1965 | Cranston | 100/26 X |
| 3,213,781 | 10/1965 | Collins et al. | 100/26 |
| 3,613,557 | 10/1971 | Coleman | 100/26 |

*Primary Examiner*—Billy J. Wilhite

*Attorney, Agent, or Firm*—Becker & Becker, Inc.

[57] ABSTRACT

An arrangement for covering the guide channel of a strap-applying and tying apparatus. On one side, the apparatus has a bent or curved portion extending into and away from said guide channel for varying the length of the guide channel in conformity with an item about which a strap or band is to be placed. The apparatus also includes channel covers or cover plates arranged on the one side and urged to cover the guided channel by means of springs. The cover plates and the springs therefor are mounted on a flexible member, which, together with the bent portion, is displaceably arranged relative to the guide channel; in this connection, the flexible member is held along a boundary side of the guide channel in a guide. The flexible member is passed at least in part around a wheel or roll for changing its direction of travel.

4 Claims, 3 Drawing Figures

11
14
15
23
12
22
24

ARRANGEMENT FOR COVERING A GUIDE CHANNEL

The present invention relates to an arrangement for covering the guide channel of a strap-applying and tying apparatus, said apparatus having on one side a bent or curved portion extending into and away from said guide channel to form an extension thereof for varying the effective length of the guide channel in conformity with an item about which a strap is to be placed, said apparatus also including channel covers or cover plates arranged on one side and being urged to cover the guided channel by means of springs.

Such guide channels serve to guide bands, straps, or the like in strap-applying and tying apparatus; accordingly, the effective length thereof is to be in conformity with the item about which a band or strap is to be placed. Since a given apparatus must be adapted to place bands or straps about items of various sizes, the length of the guide channels must be reduced at times for smaller items, or increased for larger items. In known apparatus of this type, this adjustment is achieved in such a way that laterally there extends into and away from the guide channel a movable bent portion into which the band or strap extends from the guide channel, although the strap may also extend from the bent portion into the guide channel. The portion of the guide channel which is arranged rearwardly of the bent portion, viewed in the direction of travel, is thus not utilized. By moving the bent portion along the guide channel, the effective length, and, thus, the effective length of the apparatus, can be varied at will and can be adapted to the pertaining item that is to be handled by the apparatus.

The respective cover plate at the location at which the bent portion extends into the guide channel, has to be adapted to allow introduction of the bent portion. This means that between the bent portion and the next cover plate, which is held in closing position, there is provided a region which is not covered. This region leads to operational problems, since at times the end of the band will leave the guide channel through this opening, which is not desirable, of course.

It is an object of the present invention to provide an arrangement which affords variation of the operation length of the guide channel by moving the bent portion relative thereto, whereby uncovered areas of the guide channel between the bent portion and the closing cover plates are prevented.

This object, and other objects and advantages of the present invention, will appear more clearly from the following specification in conjunction with the accompanying drawings, in which.

The arrangement according to the present invention is characterized primarily in that the cover plates and the springs therefor are mounted on a flexible member, which, together with the bent portion, is displaceably arranged relative to the guide channel; in this connection, the flexible member is held along a boundary side of the guide channel in a guide. The invention is further characterized in that the flexible member is passed at least in part around wheel or roll means for changing its direction of travel.

In accordance with another aspect of the invention, also the tensioning and closing system of the apparatus is secured to the flexible member and is adapted to be moved in both directions.

In accordance with another aspect of the invention, the flexible member is a chain.

In accordance with a preferred aspect of the invention, the flexible member includes rigid section members connected by linkage members.

Figure 1:
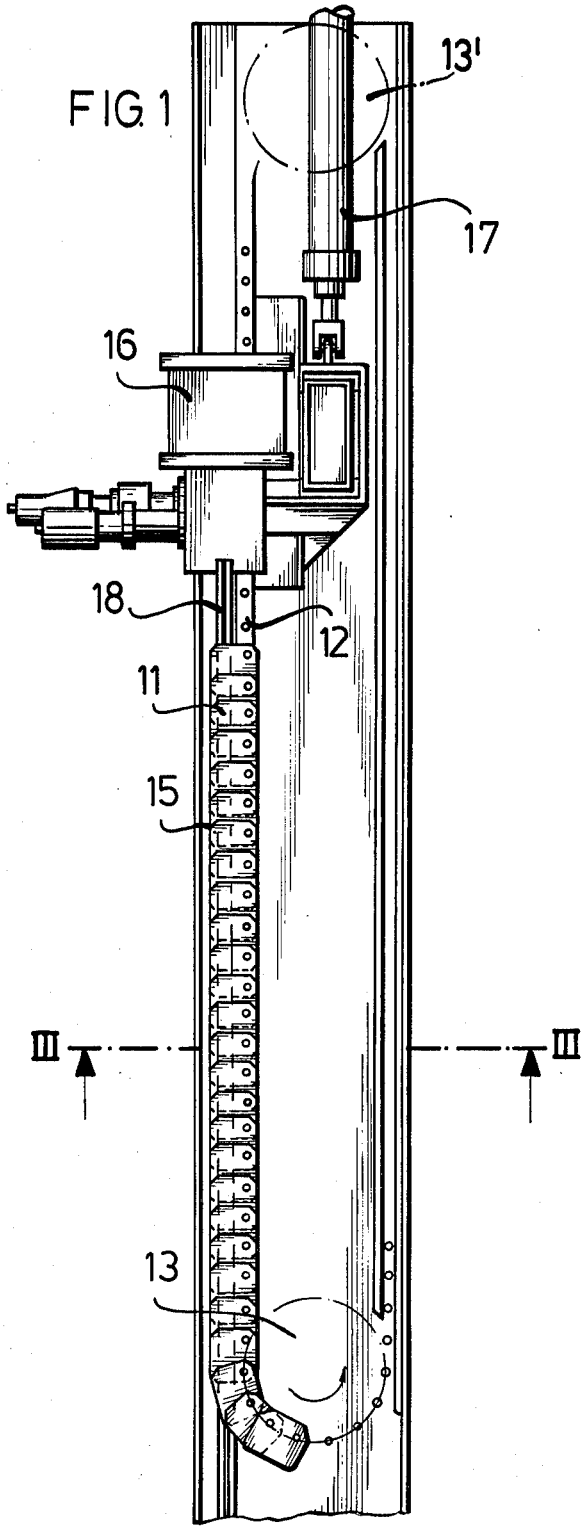
FIG. 1 is a top plan view showing part of the strap-applying and tying apparatus with an arrangement in accordance with one embodiment of the invention.
Figure 3:
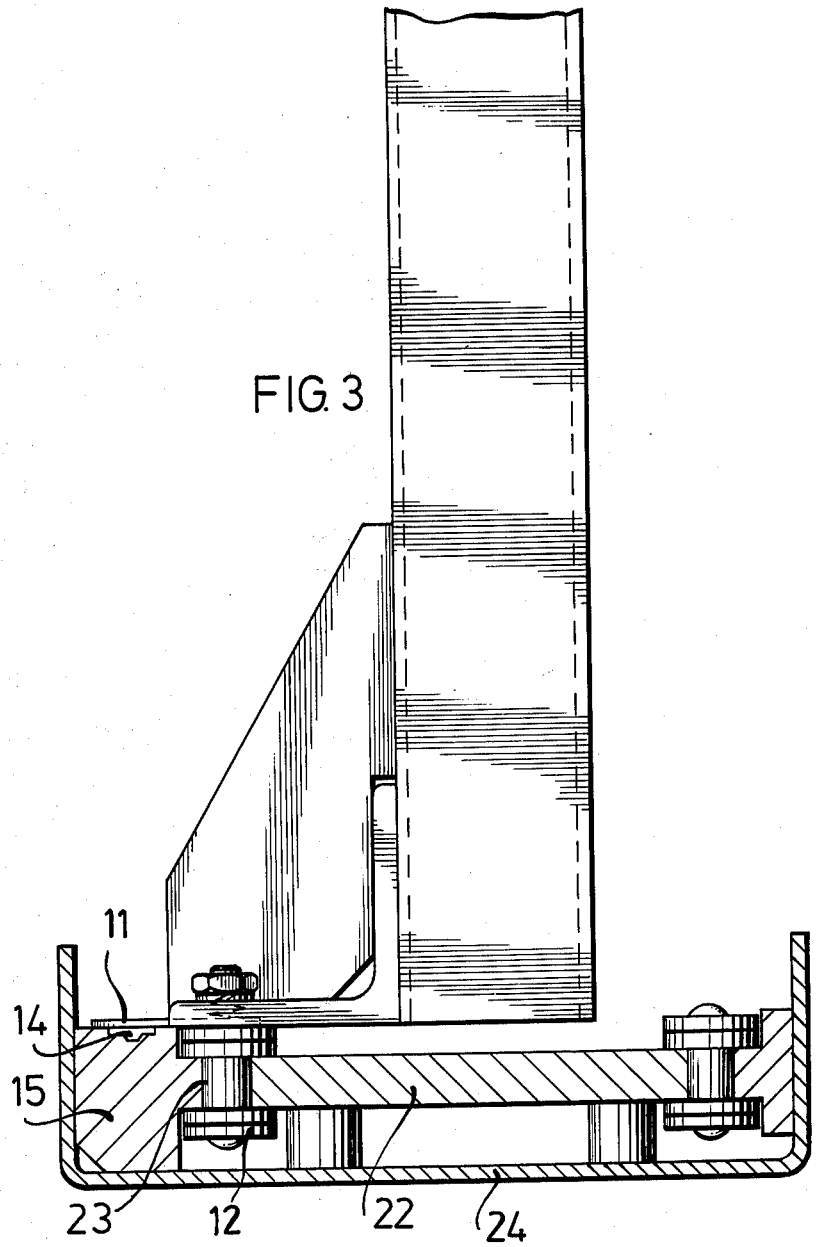
FIG. 3 is a cross section along line III—III of FIG. 1 through the guide channel and the guide of the chain.

Referring now particularly to the drawings, as shown in FIG. 1, the cover plates or channel covers 11 are resiliently secured to a chain 12, which is passed around wheels 13 and 13', for example sprocket or gear wheels. The cover plates 11 cover, in a known manner, the gap 14 of the guide channel 15 (FIG. 3). A tensioning and closing system 16 is also secured to the chain 12. In the upper portion of FIG. 1, the chain 12 is passed around the wheel 13', and the two ends of the chain are connected to provide an endless chain. The system is powered by a piston-cylinder unit 17, so that the tensioning and closing system 16, indicated in FIG. 1, and the bent portion 18, can be moved relative to the item about which a strap or band, not shown, is to be placed.

Figure 2:
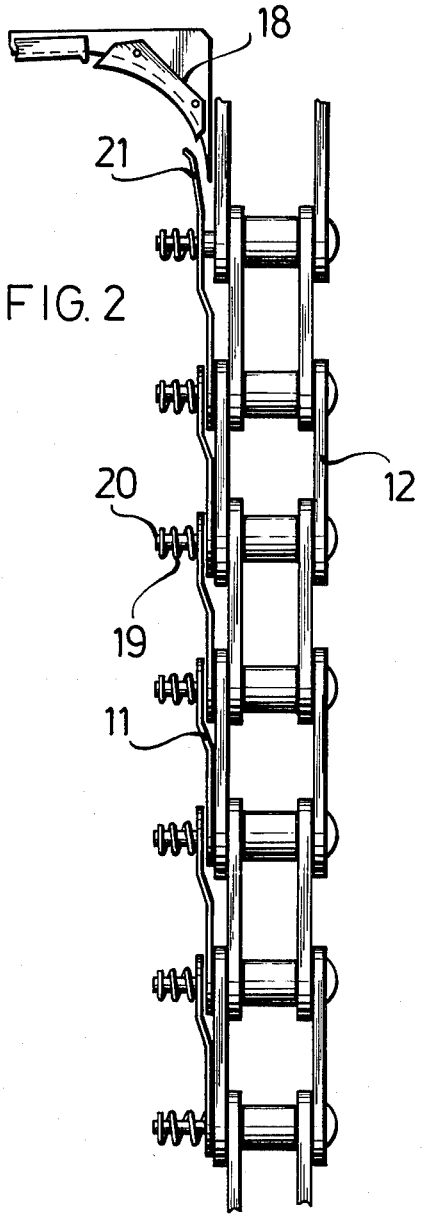
FIG. 2 is a detailed side elevational view showing a part of a chain with cover plates, and a bent portion in accordance with one embodiment of the invention.

Attachment of the cover plates 11 to the chain 12 is indicated in FIG. 2. The cover plates 11 are resiliently mounted on the pins 20 of the chain links by intervention of springs 19. An adequate clearance or play between the pins 20 and the bores of the cover plates 11 assures, in a known manner, that the cover plates 11 can be lifted without special hings means being required.

The cover plate 11 which is closest to the bent portion 18 has a somewhat upwardly bent rim or edge 21, which is in conformity with the curvature of the bent portion 18.

The chain 12 is adapted to glide or slide within its loop along a guide 22, and is guided on its outer side by the side 23 of the guide channel 15. The guide channel 15, the chain 12, and the guide 22 are arranged within the frame 24 of the apparatus.

Passing the chain at least in part around a gear or roll has the advantage that the unused channel covers are guided completely away from the guide channel, so that they do not interfere during exit of the band or strap.

The present invention is, of course, in no way restricted to the specific disclosure of the specification and drawings, but also encompasses any modifications within the scope of the appended claims.

What I claim is:

1. An arrangement for covering the guide channel of a strap-applying and tying apparatus having on a first side a bent member adapted to extend into and away from said guide channel for varying the length of said guide channel in conformity with an item about which a strap is to be placed, said arrangement comprising:

channel covers arranged on said first side, each of said channel covers being inherently urged by a spring to cover said guide channel;

a flexible member operatively connectible to said channel covers and said springs for moving said channel covers such that they cover the guide channel opening a predetermined length thereof, said flexible member being adapted to move along the one side of said guide channel;

guide means, operatively connectible to a pertaining base portion of said apparatus, for guiding said flexible member along a pertaining side of said guide channel during movement of said flexible member;

at least one wheel means, operatively connectible to said apparatus, for changing the direction of travel of said flexible member relative to said guide channel; and means for moving said flexible member and said bent portion simultaneously in the longitudinal direction of said guide channel to effect said change of length of said guide channel.

2. An arrangement according to claim 1, which includes a tensioning and closing system operatively connectible to said flexible member, said system being movable in at least two directions of travel.

3. An arrangement according to claim 1, wherein said flexible member is a chain means.

4. An arrangement according to claim 1, wherein said flexible member comprises rigid section members connectible by linkage members.

* * * * *